US007378934B2

(12) United States Patent
Marchini et al.

(10) Patent No.: US 7,378,934 B2
(45) Date of Patent: May 27, 2008

(54) NEGATIVE RATE SWITCH METHODS AND SYSTEMS FOR RESILIENT ACTUATING DEVICE

(75) Inventors: Michael G. Marchini, Freeport, IL (US); Edward L. Stern, Lanark, IL (US)

(73) Assignee: Honeywell International Inc., Morristown, NJ (US)

( * ) Notice: Subject to any disclaimer, the term of this patent is extended or adjusted under 35 U.S.C. 154(b) by 396 days.

(21) Appl. No.: 11/008,543

(22) Filed: Dec. 9, 2004

(65) Prior Publication Data

US 2005/0275501 A1 Dec. 15, 2005

Related U.S. Application Data

(63) Continuation-in-part of application No. 10/714,010, filed on Nov. 14, 2003, now Pat. No. 6,847,000.

(51) Int. Cl.
*H01H 37/18* (2006.01)
*H01H 37/12* (2006.01)

(52) U.S. Cl. ..... 337/360; 337/333; 337/392

(58) Field of Classification Search ..... 337/333, 337/347, 349, 357, 360, 368, 57, 67, 82, 337/94, 392

See application file for complete search history.

(56) References Cited

U.S. PATENT DOCUMENTS 2,024,217 A * 12/1935 Grady ..... 335/37
2,220,752 A * 11/1940 Blanc ..... 337/362
2,228,522 A * 1/1941 Johnson ..... 200/452
2,320,437 A * 6/1943 Jennings ..... 335/37
2,564,120 A * 8/1951 McLean ..... 236/9 R
2,681,965 A * 6/1954 Kebbon ..... 337/344
2,702,844 A * 2/1955 Kronmiller ..... 337/359
2,750,473 A * 6/1956 Kiley ..... 337/347
3,080,465 A * 3/1963 Pelishek ..... 337/300
3,154,654 A * 10/1964 Woods et al. ..... 337/80
3,673,535 A 6/1972 Roseberg et al.
3,720,107 A * 3/1973 Shepard ..... 60/529
3,792,403 A * 2/1974 Bullock ..... 337/66
3,859,616 A * 1/1975 Ladany ..... 337/300
3,876,845 A 4/1975 Griffith et al. ..... 200/76
3,975,703 A * 8/1976 Andresen, Jr. ..... 337/374

(Continued)

FOREIGN PATENT DOCUMENTS

DE 886484 8/1953
EP 0311024 4/1989
EP 0837483 4/1998

*Primary Examiner*—Anatoly Vortman
(74) *Attorney, Agent, or Firm*—Kermit D. Lopez; Luis M. Ortiz

(57) ABSTRACT

Methods and systems for actuating a negative rate switch. A negative rate switch comprising a plunger and a resilient actuator thereof can be provided, wherein a highest plunger force occurs at a free position and a lowest plunger force occurs at a full over travel position. The negative rate switch can be configured such that when the resilient actuator provides resilient actuating force to overcome a free position force associated with the free position, the plunger moves without interruption through a total range of travel thereof and when the resilient actuating force drops slightly below a full over-travel plunger force associated with the full over travel position, the negative rate switch overcomes the resilient actuating force to return the plunger to the free position thereof without interruption.

23 Claims, 7 Drawing Sheets

U.S. PATENT DOCUMENTS

| | | | | | |
|---|---|---|---|---|---|
| 4,032,734 | A | | 6/1977 | Burch | 200/67 DA |
| 4,587,387 | A | | 5/1986 | Piguet | 200/67 D |
| 4,644,115 | A | | 2/1987 | Nishimori et al. | 200/67 D |
| 4,775,099 | A | * | 10/1988 | Podlipnik | 236/1 C |
| 4,919,196 | A | * | 4/1990 | Podlipnik | 165/255 |
| 5,262,752 | A | | 11/1993 | Truong et al. | 337/373 |
| 5,467,523 | A | | 11/1995 | Seaman | 29/622 |
| 5,555,972 | A | | 9/1996 | Schwab | 200/451 |
| 5,790,010 | A | | 8/1998 | Schwab | 337/365 |
| 5,941,371 | A | | 8/1999 | Kautz et al. | 200/318 |
| 5,950,811 | A | | 9/1999 | Kautz et al. | 200/407 |
| 6,496,097 | B2 | | 12/2002 | Frank | 337/323 |
| 6,525,641 | B1 | | 2/2003 | Frank | 337/365 |
| 6,528,748 | B2 | | 3/2003 | Harris et al. | 200/81.9 |
| 6,538,553 | B2 | | 3/2003 | Yu | 337/365 |
| 6,847,000 | B1 | | 1/2005 | Marchini et al. | |
| 2004/0036565 | A1 | | 2/2004 | Farrey et al. | |

* cited by examiner

NEGATIVE RATE SWITCH METHODS AND SYSTEMS FOR RESILIENT ACTUATING DEVICE

CROSS REFERENCE TO RELATED PATENT APPLICATIONS

This patent application is a continuation-in-part of U.S. patent application Ser. No. 10/714,010, "Negative Rate Snap-Acting Switch Apparatus and Method," which was filed with the U.S. Patent & Trademark Office on Nov. 14, 2003 now U.S. Pat. No. 6,847,000, the disclosure of which is incorporated herein by reference in its entirety.

TECHNICAL FIELD

Embodiments are generally related to electromechanical switches. Embodiments also relate to thermostats. In addition, embodiments relate to electro-mechanical switches, which can be adapted for use with thermostats.

BACKGROUND OF THE INVENTION

Electro-mechanical switches are utilized in a variety of industrial, consumer and commercial applications. Certain types of electrical switching applications require a mechanical switch that can operate properly with a slowly applied, low-actuation force. Such a switch must also be extremely reliable and generate an accurate, repeatable response, while possessing a small actuation differential. These requirements arise perhaps most commonly in applications involving electro-mechanical thermostats, which are utilized for controlling heating and cooling in homes and buildings where coils of standard bi-metal strips form the switch actuation elements. For many years this thermostatic switching function has been performed by mercury bulb switch elements.

Due to the environmental concerns associated with the use of mercury, it is anticipated that electromechanical switches will eventually replace mercury-based switches. Legislation currently being drafted and passed in a variety of countries, including the United States, is aimed at banning the use of mercury in most consumer-based applications. Thus, non-mercury based switches must be developed to replace such mercury-type switching mechanisms.

Some attempts have been made at replacing mercury-switching devices, but such attempts have not been very successful. For example, so-called "snap action" switches have been designed to address the environmental concerns that mercury bulb switch elements raise. As utilized herein, the term "snap action switch" generally refers to a low actuation force switch, which utilizes an internal mechanism to rapidly shift or snap the movable contact from one position to another thus making or breaking electrical conduction between the movable contact and a fixed contact in response to moving an operating element of the switch, such as a plunger, a lever, a spring, or the like from a first to a second position. Typically, these switches require only a few millimeters of movement by the operating element to change the conduction state of the switch.

Such switches can safely and reliably operate at a current level of several amperes using the standard 24 VAC power that thermostats control. However, when actuated by a slowly-applied, low-actuation force such as is provided by a thermostat's coiled bi-metal strip, snap action switches may occasionally hang in a state between the two conducting states, or may switch so slowly between the two conducting states that unacceptable arcing and/or heat-rise can occur when entering the non-conducting state. Either condition gives rise to unacceptable reliability and predictability of operation.

Furthermore, such switches frequently possess unacceptably large differentials, which means that the position of the operating element at which actuation of the switch to one state occurs differs substantially from the position of the actuation element at which actuation of the switch to the other state occurs. If the differential is too large, then the temperature range that the controlled space experiences is also too large. Accordingly, the use of snap action switches in thermostat-type applications has not been particularly successful.

Electronic thermostats are generally known in the art. An example of an electro-mechanical thermostat that has been utilized in commercial, consumer and industrial applications is the T87 thermostat produced by Honeywell International, Inc. ("Honeywell"). An example of the T87 thermostat is disclosed in the publication "Thermostats T87F," Form Number 60-2222-2, S. M. Rev. April 1986, which is incorporated herein by reference. Another example of the T87F thermostat is disclosed in the publication "T87F Universal Thermostat," Form Number 60-0830-3, S. M. Rev. August 1993, which is also incorporated herein by reference. The T87F thermostat, in particular, provides temperature control for residential heating, cooling or heating-cooling systems.

An example of a switch assembly which in various forms can be utilized in thermostat applications is disclosed in U.S. Pat. No. 6,720,852, "Methods and Apparatus for Actuating and Deactuating a Switching Device Using Magnets" which issued on Apr. 13, 2004 to Farrey et al, and which is assigned to Honeywell International Inc. U.S. Pat. No. 6,720,852 is incorporated herein by reference.

One of the problems encountered in the efficient utilization of many thermostats in use today is the problem of actuating an electro-mechanical switch with a slow-moving actuator, such as a bi-metal coil, without sacrificing the switch's electrical life. For example, mechanical thermostats, such as the T87 line of thermostats manufactured by Honeywell, utilize a bi-metal coil as the temperature-sensing device. In the operation of the thermostat, the bi-metal coil moves a small amount at a slow rate.

Actuating a switch directly off the bi-metal coil results in an inordinate amount of time spent, during the switching cycle, at or near snap-over. Electro-mechanical switches have low contact forces near snap-over and zero contact forces at snap-over. When the switch contact forces are low or zero, the amount of electrical resistance at the contact interface increases. As the electrical resistance to current passing through the switch increases, the heat also increases. The electrical life of an electro-mechanical switch is reduced with time as the current is carried at or near the snap-over points.

Unacceptable electrical switching performance can occur in switching applications where the actuating force is resilient in nature and varies for indefinite periods of time slightly below the switch operate force or slightly above the switch release force. Switches are frequently designed and adapted for use with devices that monitor and/or control changes in attributes such as position, pressure, temperature, acceleration, and the like.

In many of these applications, the sensing element that interfaces between the switch mechanism and the system attribute being sensed is resilient. For example, temperature changes can be translated into movement via a coiled bimetal spring. The coiled bimetal responds to temperature changes and acts as a force sensitive (resilient) actuator to drive the switch mechanism. The bimetal is resilient because its position is dependent on force, or vice versa; whereas, a non-resilient (rigid) actuator does not change position as the force against it varies.

Other examples of switch actuators with resilient force-deflection spring rates include bellows, bourdon tubes, diaphragms, floats, clampers, and magnets. Fixed masses, gravitational and non-gravitational accelerations can also be used to create switch actuators that have a resilient nature. If a mass is attached to the external lever of a switch and the switch, external lever, and attached mass assembly is rotated about an axis that is not parallel to the force due to gravity or coincident with the mass's center of gravity, the resulting moment that actuates the switch is a function of the angle of rotation of the switch, external lever, and mass assembly.

In general, if a fixed mass is placed against the switch mechanism and accelerated, a force can be exerted, which is approximately equal to the product of the mass and the acceleration in a direction opposite to the acceleration. Because the mass is fixed, the actuating force against the switch mechanism is a function of acceleration. In all of these applications, the resilient interface responds to a change in stimulus (pressure, temperature, acceleration, etc.) and moves to drive a switch mechanism through some travel range to energize an electrical circuit.

For reliable and predictable electrical switching performance, it is desirable to maintain maximum contact force until the point of actuation or de-actuation. In non-snap switches and the vast majority of precision, snap-action switches, contact forces are at a maximum at the plunger free position (plunger fully extended) and the full over-travel position (plunger fully depressed). Contact force diminishes to zero as the switch mechanism approaches the operating point, the plunger position at which the switch changes electrical state from the normally-closed (NC) circuit to the normally-open circuit (NO).

Likewise, contact force decreases to zero as the switch mechanism approaches its release point, the plunger position at which the switch changes state from the NO circuit back to the NC circuit. As the contact force varies at or near zero, the switch is susceptible to intermittent non-contact, welding of contacts, and excessive heat generation and contact erosion. In addition, once actuation or de-actuation commences, it is desirable that the switch mechanism moves from free position to full over-travel position, or vice versa, in one continuous motion. The uninterrupted motion of the switch mechanism from free position to full over travel results in a minimum amount of time spent near zero contact force and in a maximum relative movement between the moveable contact and the stationary contacts between switching events.

Precision snap-switches, which typically possess a positive rate force-deflection behavior, are commonly utilized in applications where the actuating force is resilient in nature. The plunger force of a positive rate snap switch, for example, can increase as the plunger is depressed from free position to the operating position. Because of the increase in force required to continue plunger movement when a positive rate switch is actuated with a resilient actuator, a balance of forces can occur. The balance of force between the resilient actuator and positive rate switch mechanism becomes unbalanced when the resilient actuator responds to a change in the attribute being sensed.

Changes in the sensed attribute result in an increase or decrease of the force generated by the resilient actuator. Often times the sensed attribute changes very slowly over time, as in the case of a thermostatic bimetal. This results in the switch plunger moving in small increments over a long period of time; which can cause erratic non-contact (dead break), arcing, or welding of the electrical contacts. If the resilient actuator and switch mechanism forces remain balanced, the switch plunger will not move. The balanced condition is detrimental to the electrical switching performance if the switch mechanism is in a position where the contact forces are very low. With some positive rate switches, the resilient actuator force and switch mechanism force can balance during the plunger movement from full over travel to release point; resulting in poor electrical switching performance.

BRIEF SUMMARY

The following summary is provided to facilitate an understanding of some of the innovative features unique to the present invention and is not intended to be a full description. A full appreciation of the various aspects of the embodiments disclosed herein can be gained by taking the entire specification, claims, drawings, and abstract as a whole.

It is, therefore, one aspect of the present invention to provide for an improved electro-mechanical switch.

It is another aspect of the present invention to provide for improved electro-mechanical switches, which can be adapted for use with thermostats.

It is an additional aspect of the present invention to provide for an improved negative rate switch.

It is a further aspect of the present invention to provide for negative rate switch methods and systems for a resilient actuating device.

The aforementioned aspects and other objectives and advantages can now be achieved as described herein. Methods and systems for actuating a negative rate switch are disclosed. In general, a negative rate switch comprising a plunger and a resilient actuator thereof can be provided, wherein a highest plunger force occurs at a free position and a lowest plunger force occurs at a full over travel position. The negative rate switch can be configured such that when the resilient actuator provides resilient actuating force to overcomes a free position force associated with the free position, the plunger moves without interruption through a total range of travel thereof and when the resilient actuating force drops slightly below a full over-travel plunger force associated with the full over travel position, the negative rate switch overcomes the resilient actuating force to return the plunger to the free position thereof without interruption.

Thus, when the force-deflection spring rates of a resilient actuator and a negative rate switch are properly matched, the switch mechanism and resilient actuator can move in an uninterrupted motion from free position to the full over travel position, or vice versa. With a negative rate switch, as disclosed herein, the highest plunger force occurs at free position and the lowest plunger force occurs at full over travel. When the resilient actuating force overcomes the free position force, the negative rate switch plunger moves without interruption through its total range of travel. Likewise, once the resilient actuating force drops slightly below the full over-travel plunger force, the negative rate switch overcomes the resilient actuating force and returns the plunger to free position without interruption. A properly matched resilient actuator and negative rate switch system is bi-stable with points of stability that are coincident with the maximum NC and NO contact forces.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope of such embodiments.

Figure 1:
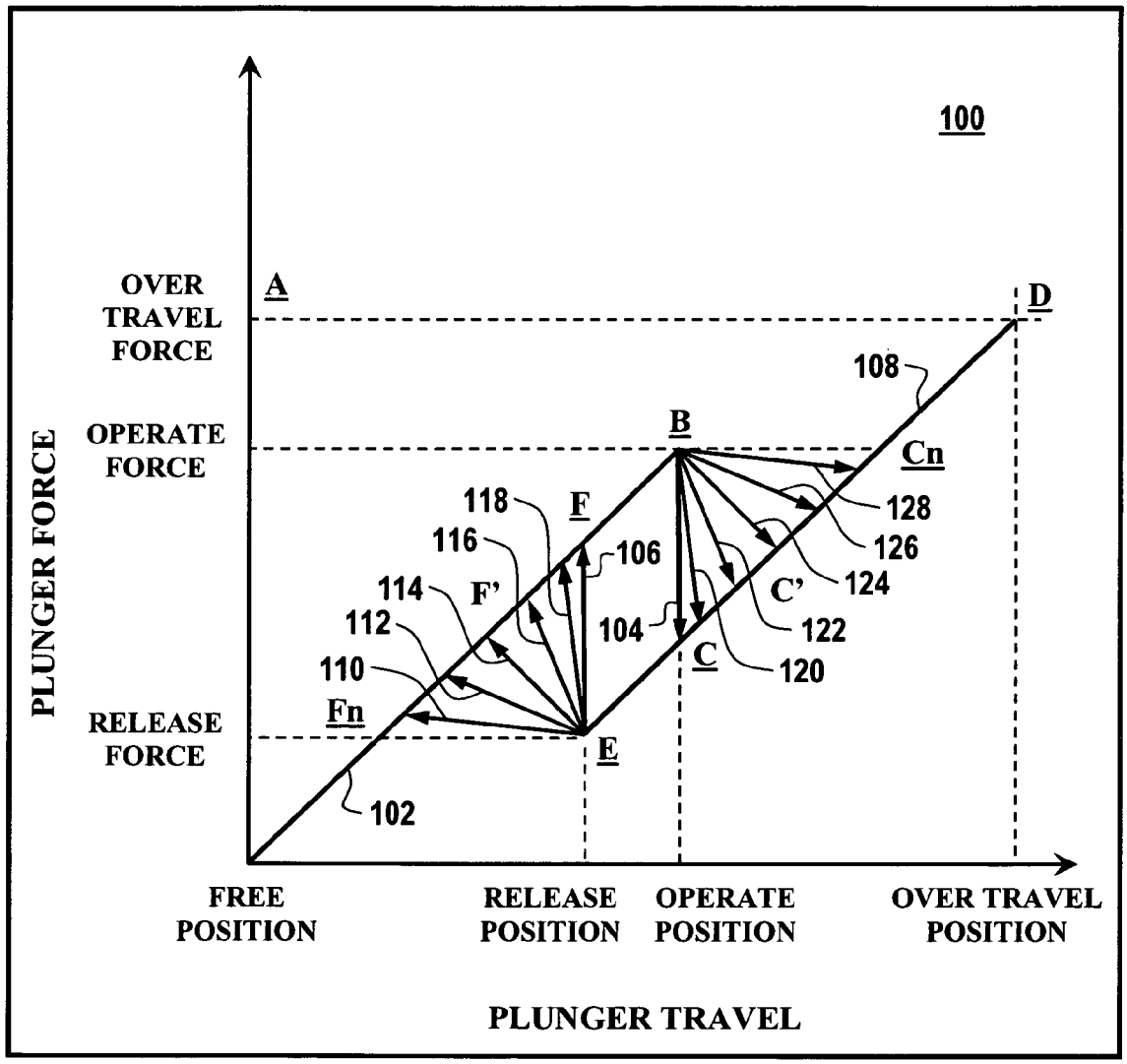
FIG. 1 illustrates a graph depicting a positive rate switch curve with resilient actuation features included.

FIG. 1 illustrates a graph 100 depicting a positive rate switch curve with resilient actuation features included. Graph 100 generally illustrates the force exerted by (or on) a positive rate switch at various travel positions of the switch plunger The shape and travel range of a plunger force versus plunger travel curve will depend on the design of the particular switch mechanism. A typical force-deflection curve for a precision snap-acting switch, when operated with a rigid actuator, is indicated in graph 100 of lines 102, 104, 106, and 108, which together form a single data curve. Examples of rigid actuating members are thick levers, cams, rollers, and pins.

Many conventional precision switch designs possess a total plunger travel of one millimeter or less at the switch plunger. For a precision switch the force developed during the plunger pre-travel (distance from free position to the operate position) is usually proportional to the amount of plunger travel. Thus, the switch force is approximately a linear function of plunger travel as illustrated in graph 100 of FIG. 1. Some of the less precise and larger travel range switch designs (e.g., up to 2.5 mm or more) have non-linear plunger force versus travel behavior but still exhibit a positive spring rate for most of the switch plunger pre-travel range.

Point A in graph 100 of FIG. 1 can be utilized to denote free position of the switch where little or no force exists at the plunger. During the pre-travel of the switch plunger from point A to the operating point, designated as point B, mechanical energy is stored in the switch mechanism. When the plunger reaches the operating point B, some of the stored energy is used by the switch mechanism to cause "snap-over" of the moveable contact from the normally closed to the normally open position.

During snap-over of the moveable contact the plunger does not move from its position at point B when the actuator is a rigid device. But the force the switch plunger applies to the actuator drops to point C after the moveable contact reaches the normally open stationary contact position. As the switch plunger is then moved into the over-travel range the plunger force increases along the line from point C to point D. In reversing the direction of the plunger travel and gradually releasing the plunger the same line is retraced from point D to point C.

The path, however, continues in the same direction beyond point C to point E, the release point. At point E with no further movement of the plunger, the switch mechanism utilizes stored energy to snap back the moveable contact to its original normally closed position, and the force applied by the plunger increases from point E to point F. As the plunger is released further the plunger force retraces the curve from point F back to point A, the free position.

The area under the curve ABCD represents mechanical energy put into the switch and the area under DCEFA represents the energy returned by the switch to the rigid actuating device. The area BCEF represents the energy utilized by the switch mechanism in snapping the moveable contact over and back.

When a resilient actuating device is utilized, such a device merely changes the location of points C and F. In this case starting with the plunger at point A, the resilient actuating device depresses the plunger with force varying linearly with travel as shown by line AB. At point B, the operating point, the switch mechanism snaps over, but this time the switch plunger moves because the actuator is resilient or non-rigid while the switch force is changing. Instead of arriving at point C as the plunger did with a rigid actuating device, the plunger arrives at some point C' between points C and Cn, the exact location of which is determined by the spring properties of the resilient member.

Although the possible paths for BC' are shown as straight lines 110, 112, 114, 116, 118, 120, 122, 124, 126, 128 depicted in graph 100 of FIG. 1, the force-deflection path for the resilient actuator is not necessarily linear. For simplicity, however, the force-deflection path is depicted in FIG. 1 as linear. Its actual shape is usually not important, but the location of point C' between points C and Cn can be of considerable interest. For a resilient actuating device with a spring rate K (force per unit travel), point C' can be located along line C-Cn by drawing a straight line with a slope of −K through point B. In similar fashion, the release point E remains unchanged but after snap back of the switch plunger by a resilient actuator the plunger is at some point F' instead of point F. Again to locate point F' a straight line with slope −K can be drawn through point E until it intersects line AB.

Gas filled corrugated diaphragms, thermal bellows, and coiled bimetal springs are examples of temperature reacting resilient actuators used to convert a change in temperature into the force-deflection energy needed to actuate a switch mechanism and control an electrical circuit. As these types of actuators are limited in the amount of mechanical energy they are able to produce, demands are often made of the switch mechanism to have low operate force, low differential travel, and low total travel.

Precision switch designs can satisfy requirements for low force and low travel, but the mechanical energy available to produce snap action is also lowered. The result of a "weaker" snap is less kinetic energy available at the moveable contact for impacting the stationary contact to break through any alien films and make good electrical contact. Reducing force-travel characteristics for the switch in order to interface with temperature-reacting resilient actuators also results in poor contact weld-breaking ability, less resistance to vibration, low contact force, excessive switch resistance, unacceptable arcing conditions, and intermittent electrical contact near the operate and release positions.

The slow rate of actuation developed by temperature reacting resilient actuators to drive a positive rate mechanical switch increases the opportunity for unwanted non-contact to occur. Non-contact is a condition that can occur even as the moveable contact surface is physically touching the stationary contact. As the switch plunger slowly moves toward the operate point B, contact force may become so low that high electrical resistance develops at the contact interface, and the switch can no longer conduct enough current to energize the device being controlled.

Non-contact may also occur because of low switch plunger velocity at point B, the start of snap-over and just after, where the moveable contact begins to separate from the normally closed stationary contact. The movement of the moveable contact may actually stall for a time during its transition to the normally open stationary contact in a non-conducting state. Whatever the source of a non-contact condition, the distance of plunger travel during which electrical non-conduction occurs is called dead-break. Excessive dead-break, just as a larger differential travel (the plunger travel from the operate to release position), widens the differential pressure or temperature range the switch is capable of controlling. Increased inaccuracy and reduced repeatability of the switch operate and release points also result from excessive dead-break.

Figure 2:
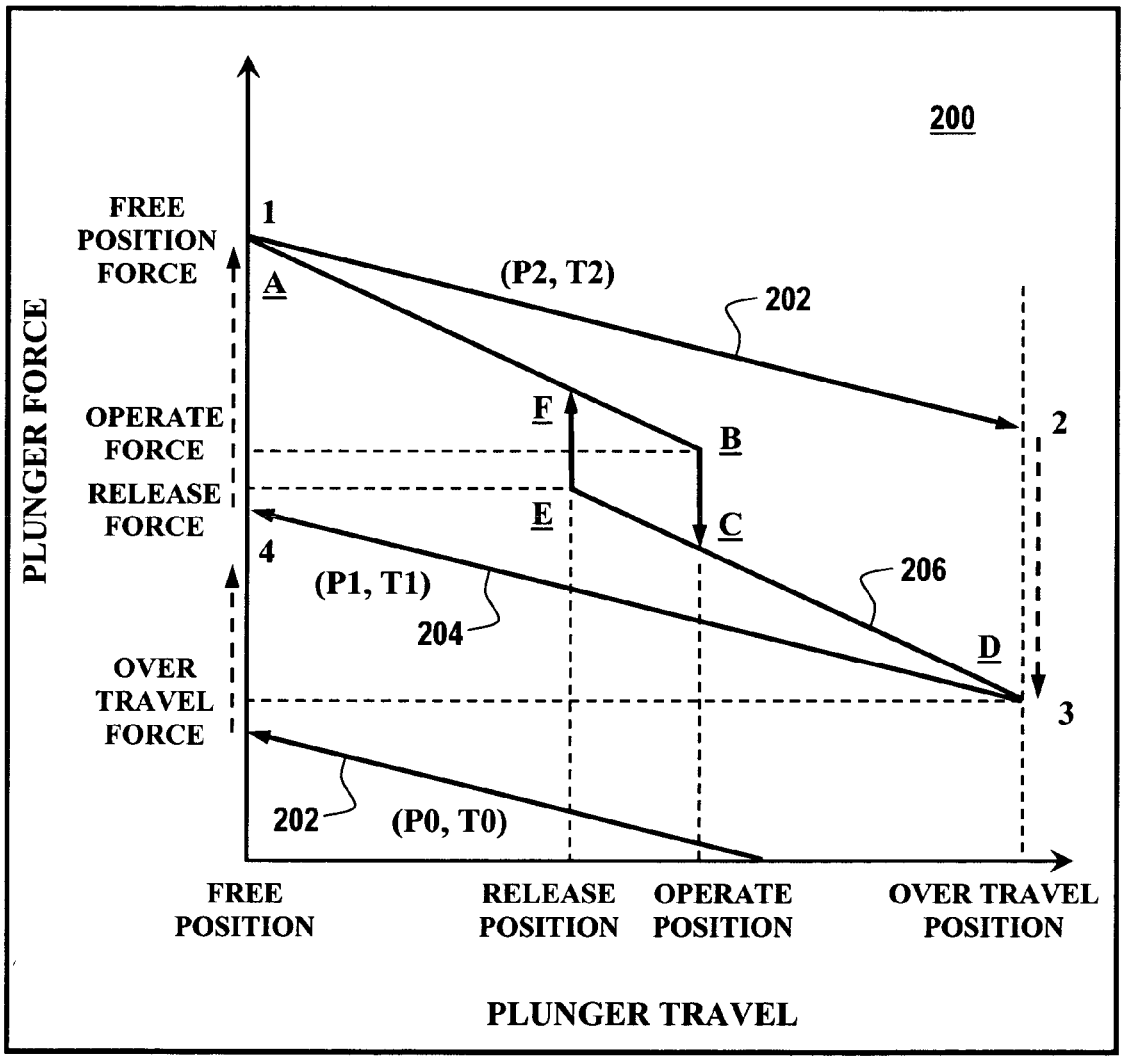
FIG. 2 illustrates a graph depicting a negative rate switch curve with resilient actuation included, in accordance with a preferred embodiment.

FIG. 2 illustrates a graph 200 depicting a negative rate switch curve with resilient actuation included, in accordance with a preferred embodiment. Note that the embodiment disclosed herein generally describe a methodology and system that employs a negative rate switch with a resilient actuator member to overcome the electrical contact performance problems associated with using a positive rate switch. Graph 200 of FIG. 2 is presented herein to assist in explaining how a resilient actuator member and a negative rate switch can function together for controlling a device. One example of a negative rate switch to which the embodiments disclosed herein can be adapted is disclosed in U.S. patent application Ser. No. 10/710,010, "Negative Rate Snap-Acting Switch Apparatus and Method," which was filed with the U.S. Patent & Trademark Office on Nov. 14, 2003.

As indicated in graph 200 of FIG. 2, point A can be utilized to denote the free position of the switch plunger. The switch force at free position is now at the highest value for any plunger travel position. For the negative rate switch the plunger force decreases along line AB as the plunger travels to operating point B. From point B the plunger force drops suddenly to point C during the moveable contact snap-over and continues to decrease during over travel as shown by line CD. As the switch plunger is slowly released from the full over travel point D, the plunger force retraces back along curve DCEFA. To summarize, the signs (+ or −) of the force-deflection slopes for a negative rate switch are just the opposite of those for a positive rate switch. Line 202 in graph 200 generally indicates the resilient spring rate on operate, while line 204 indicates the resilient spring rate upon release. Line 206 is indicative of data, which form an ideal snap switch force-deflection curve.

The solid lines 202, 204 and 208 depicted in graph 200 of FIG. 2 are idealized linear and parallel curves representing force-deflection behavior at different pressures or temperatures for a resilient actuating member. The ambient pressure or temperature force-deflection curve for the resilient member is shown as (P0, T0) or line 208. With a switch plunger present and interfacing with the resilient member, the force developed by the resilient member is not great enough to overcome the higher free position plunger force of the switch at point A. If the switch plunger is removed from blocking the resilient member, the resilient member will move along the (P0, T0) curve line 208 until its force decreases to zero.

As depicted in graph 200 of FIG. 2, the force developed by the resilient actuator would have to increase to the (P2, T2) curve to overcome the force of the switch plunger at free position point A. Point 1 denotes the force developed by the resilient member and is just slightly greater than the switch plunger force at point A. Once the resilient member forces the switch plunger to begin moving, the two move together without stopping until the switch plunger moves through its total travel range reaching a physical stop. At this point the resilient member force has decreased to point 2. The switch plunger force ends up at point D. The switch plunger, in being driven from point A to point D, moved quickly through operating point B where the electrical conduction state of the switch changed.

When the switch operated at point B, it may have turned off an electric heater that had been heating and raising the temperature of a room environment. As the temperature of the environment then cools, the resilient actuator reacts by lowering the force it generates on the switch plunger. Once the resilient force level drops to point 3, the switch plunger force at point D is now slightly greater than the force from the resilient driving member.

At the (P1, T1) curve represented by line 204, the resilient actuator can no longer develop enough force to keep the switch plunger depressed. The force from the plunger of the switch pushes the resilient member back to point 4 while the plunger returns to the free position at point A. Again the switch mechanism moved quickly through point E, the release point, where the moveable contact snapped back to the normally closed position. The electric heater would then be turned back on to start heating. Heating causes the resilient actuator to start building up force to point 1 again, and the control cycle starts over.

With a positive rate switch the resilient actuator is always in control of the force required to operate or release the plunger of the switch. The resilient actuator generates increasing force to gradually move the plunger through the operate point, the switch changes electrical state, and then the actuator force gradually decreases and the plunger follows along to return back through the release point and change back to the previous electrical state. Depending on the control setting, the total range of plunger movement for a positive rate switch may be minimal in certain pressure or temperature control applications. The resilient actuator will often limit total plunger travel of a positive rate switch to cycle back-and-forth near the switch operate and release positions represented by the closed path BC'EF' depicted in graph 100 of FIG. 1.

When a negative rate switch is combined with a resilient actuator to control pressure or temperature, the switch mechanism and resilient actuator take turns in driving the operate and release strokes of the switch plunger. In operating the switch along the plunger force curve ABCD, it is the resilient actuator that has the higher force (i.e., line 202 from point 1 to point 2 depicted in graph 200 of FIG. 2), and dominates to drive the switch plunger quickly from point A to point D. During the rapid plunger transition on the operate stroke, the switch operated at point B, the electrical conduction state changed, and the pressure or temperature stimulus was altered.

Next, the resilient actuator can react to the change in pressure or temperature by decreasing the amount of force it generates, eventually down to point 3. With the switch plunger force at point D now slightly higher than the resilient actuator force at point 3, the negative rate switch becomes the dominant force to drive the resilient actuator back to point 4 while the switch plunger moves along curve DEFA, going through release point E, and again changing electrical conduction state. To summarize, the resilient member pushes forward on the switch plunger for the operate stroke, and the switch plunger pushes back on the resilient member on the release or return stroke. The resilient member and snap-switch take turns pushing one another back-and-forth during control cycles.

Note that although temperature and pressure stimuli are described herein in order to demonstrate the negative rate switch approach disclosed by the embodiments depicted herein, the same control methodology can be utilized with any actuating force that is resilient in nature.

Regarding a bi-stable mode, it is important to note that while a positive rate switch plunger may be forced into a situation of slowly moving around the closed path BC'EF' in graph 100 of FIG. 1, the plunger movement for the negative rate switch as depicted in graph 200 of FIG. 2 will be relatively fast between the free position point A and the full over travel position point D. The negative rate switch and the resilient actuating member are designed to act as a bi-stable assembly, achieving stable positions at either end of the switch travel range while being unstable for all other plunger travel positions in between.

As indicated earlier with respect to the positive rate switch, the actual shape of the resilient actuator force-deflection curve or spring rate K from point B to point C' is usually not important. For the resilient-driven negative rate switch, however, the shape and difference between the resilient actuator and the snap-switch spring rates are quite important. As depicted in graph 200 of FIG. 2, the greater the rate difference (between lines 1-2 and A-B or between lines 3-4 and D-E), the faster and cleaner the switch plunger movement and action will be.

If the spring rates (slopes) of the resilient member and the snap-switch become too close, that is, if lines 1-2 and A-B or lines 3-4 and D-E become nearly coincident, then the switch plunger will move in a slower and somewhat "sluggish" fashion instead of the fast, clean action desired. Additionally, if the slope or spring rate of line 1-2 for the resilient actuator happens to become steeper than the slope of line A-B of the negative rate switch, then the resilient actuator will slowly walk the switch plunger through the operation stroke, the same as it does when using a positive rate snap-switch. In summary, shape and difference of the spring rates when using a negative rate switch are important. When a positive rate switch is utilized, the shape and difference in spring rates are of less concern since the resilient actuator always walks the plunger through its movement on both the operate and release strokes of the switch.

As indicated previously, the location of point C' between points C and Cn can be of considerable interest. Actually it is the distance between points C' and F' that represents the differential plunger travel required to insure switching of the electrical conduction state that is of most interest. The wider this differential plunger travel, the larger the differential control range becomes for a resilient-driven positive rate switch approach. For the resilient-driven negative rate switch concept, the amount of differential travel is not important. However the amount of force drop from point B to C becomes a real concern for a negative rate switch design.

Figure 3:
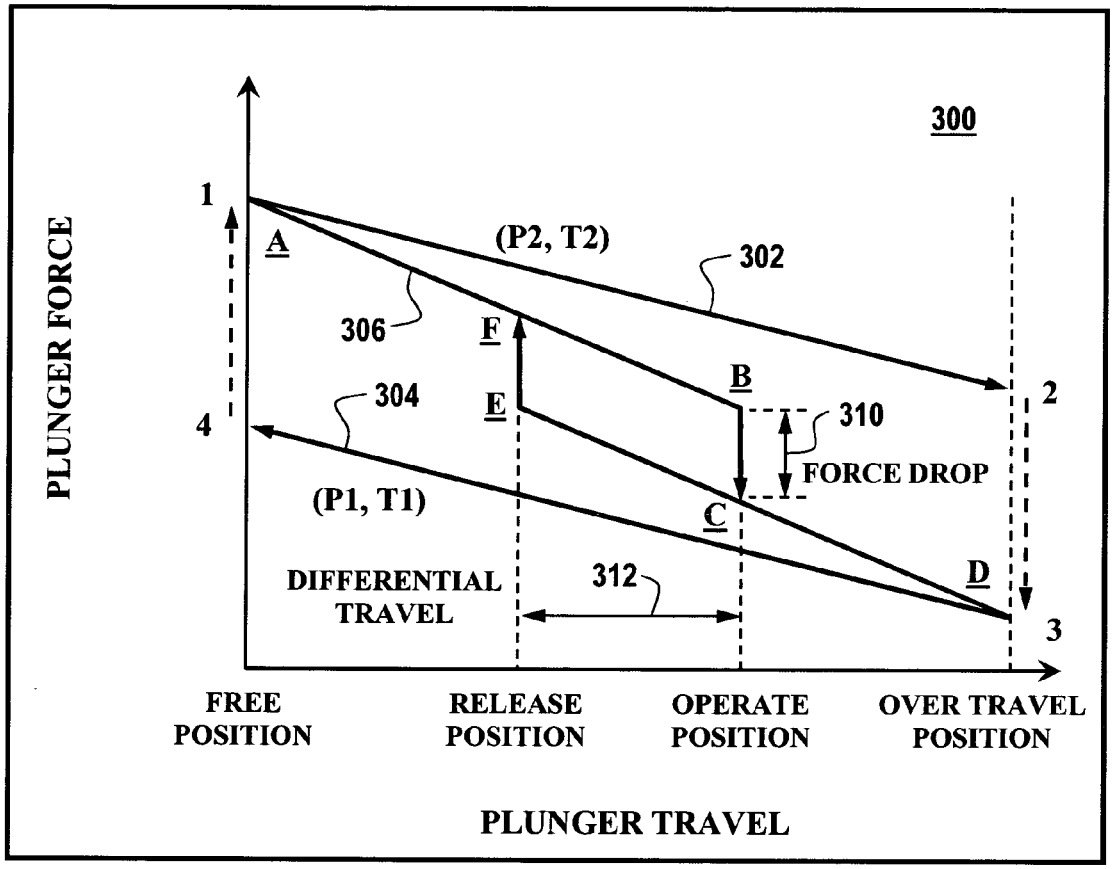
FIG. 3 illustrates a graph depicting data associated with a desirable negative rate switch design, in accordance with a preferred embodiment
Figure 4:
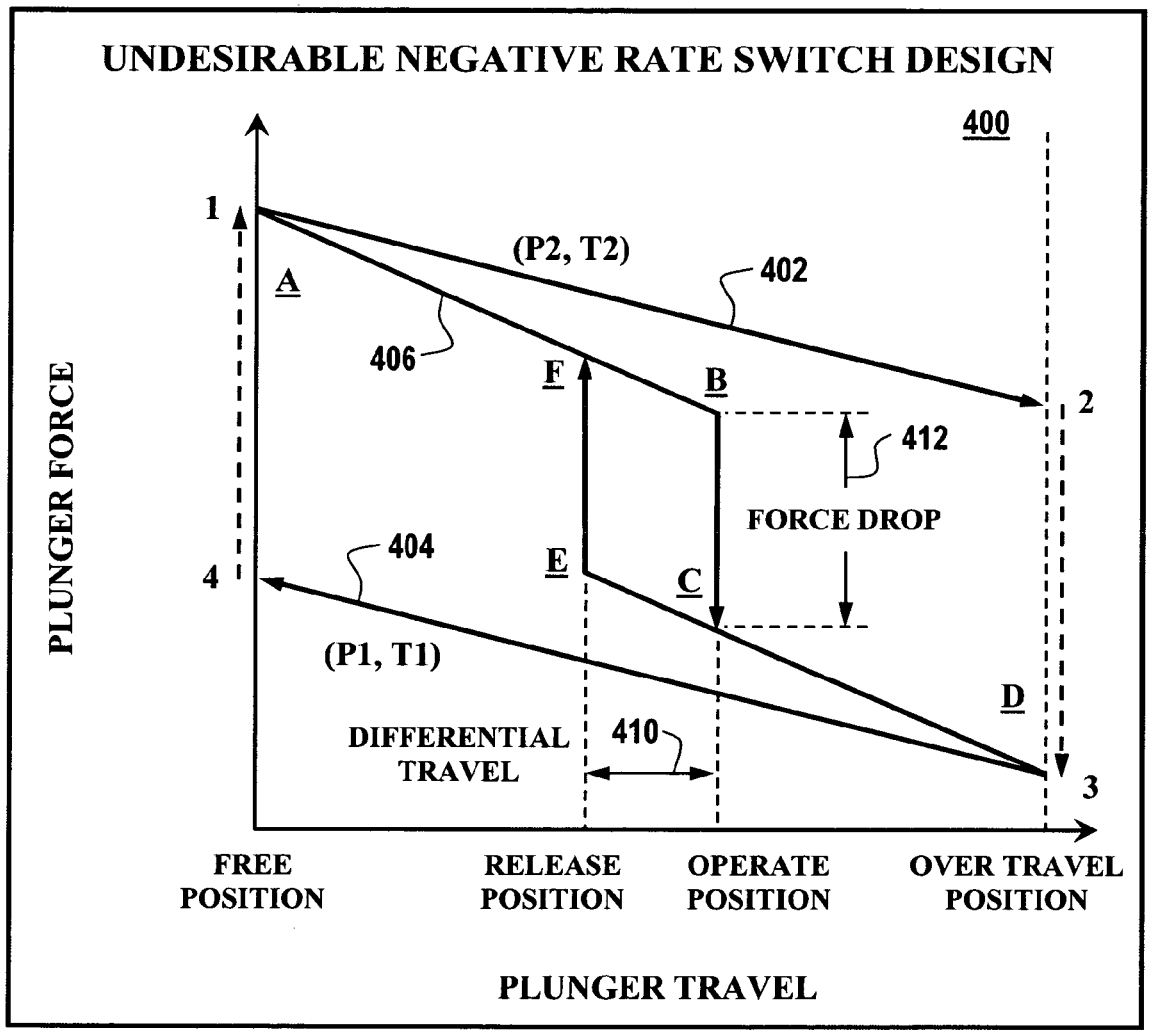
FIG. 4 illustrates a graph depicting data associated with an undesirable negative rate switch design.

A larger force change from point B to C at the operate position and from point E to F at the release position for the switch requires the distance between the resilient actuator force curves (i.e., line 202 from point 1-2 and line 204 from point 3-4) to increase and thus widen the differential control capability of the device beyond what is perhaps desirable. FIGS. 3 and 4 present a comparison of a preferred design for a negative rate switch curve with minimal force drop from point B to point C, and another design curve for a negative rate switch design with a larger drop in force from point B to point C that would not be desirable.

FIG. 3 illustrates a graph 300 depicting data associated with a desirable negative rate switch design, in accordance with a preferred embodiment. In FIG. 3, a line 302 indicates (P2, T2) data from points 1-2, while line 304 indicates (P1, T1) data from points 3-4. Line 302 represents the resilient spring rate on operate. Line 304 indicates the resilient spring rate on release. Snap switch data is indicated by line 306. Differential travel data 312 is also indicated in FIG. 3 between the release position and the operate position of the plunger travel. A drop in force is also indicated in graph 300 by line 310 between points B and C.

FIG. 4, on the other hand, illustrates a graph 400 depicting data associated with an undesirable negative rate switch design. In graph 400, a line 402 is indicated, which represents (P2, T2) from points 1-2. Line 402 presents data representing the resilient spring rate upon operate. A line 404 indicates (P1, T1) data from points 3-4, while differential travel data 410 is also indicated in graph 400 between the release position and operate position. Line 404 indicates the resilient spring rate upon release. A snap switch curve 406 is also depicted in FIG. 4. A drop in force is also indicated in graph 400 by line 412 between points B and C.

Figure 5:
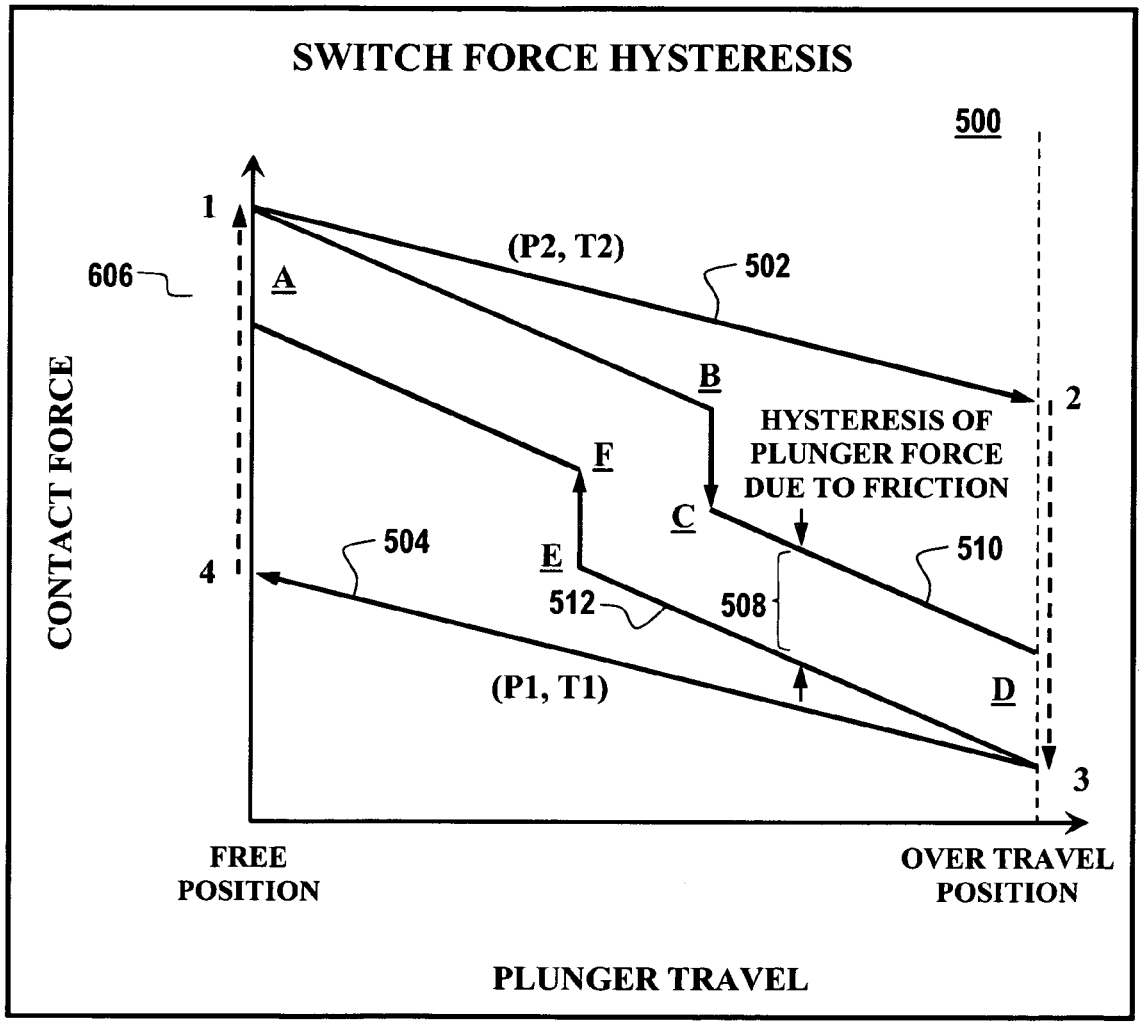
FIG. 5 illustrates a graph depicting data associated with a plunger force hysteresis, in accordance with a preferred embodiment.

FIG. 5 illustrates a graph 500 depicting data associated with a plunger force hysteresis, in accordance with a preferred embodiment. Any internal friction within the switch mechanism can cause force hysteresis or a difference in force between the operate curve AB and release curve FA, or between lines CD and DE of graph 500. Graph 500 of FIG. 5 represents an example of plunger force hysteresis that may develop from friction between sliding and rotating surfaces and the shifting of moveable components in the switch mechanism. Separation of the plunger force curves between the operate and release strokes increases the required distance between the resilient actuator force curves (i.e., curve or line 502 from points 1-2 and curve or line 504 from points 3-4 of FIG. 5) to function properly, and widens the differential control capability of the device. In graph 500, line 502 represents the resilient spring rate on operate, while line 504 indicates the resilient spring rate upon release.

The need to limit the amount of differential travel and dead-break for a resilient-driven positive rate switch is replaced by the need to limit the force drop magnitude from point B to C and plunger force hysteresis for a resilient-driven negative rate switch. To one unfamiliar with the design of resilient-driven switch mechanisms it may seem nothing is really gained by trading one set of problems for another. Attempting to overcome the dead-break associated with a resilient-driven positive rate switch approach, however, is a much tougher challenge than minimizing plunger force hysteresis for a resilient-driven negative rate switch. The reason being is that dead-break is most apparent in applications involving low plunger velocity, an inherent characteristic for many resilient-driven positive rate switch control applications. The hysteresis of the plunger force due to friction is indicated by the gap 508 between lines 510 and 512 in graph 500.

To increase plunger velocity with a resilient driven positive rate switch approach a designer must look to additional energy sources such as a wind-up spring, a relay, or a permanent magnet combined with ferromagnetic pole pieces to incorporate into the control assembly. Reducing sources of mechanical friction within a negative rate switch mechanism and at the actuator interface to minimize plunger force hysteresis is a much easier task for a designer to accomplish.

Other advantages a properly designed resilient actuator and negative rate switch assembly have when compared with a resilient-driven positive rate switch are:

1.) Fast acting, bi-stable switching action
2.) Larger possible plunger travel range for the switch mechanism
3.) Increased moveable contact translation (sliding) to displace contact contaminants
4.) Less likely to form welds at contact interfaces due to faster switch actuation
5.) Better contact weld breaking ability due to greater moveable contact rolling and sliding motion
6.) Increased resistance to mechanical vibration near switch operate and release positions
7.) Lower and more stable electrical contact resistance
8.) Less prone to electrical arcing at contact interfaces
9.) Elimination of dead-break, i.e. periods of erratic electrical non-contact near the operate and release positions for the switch are no longer a concern
10.) Robust design with improved switching performance (better accuracy and repeatability of switching points).

Figure 6:
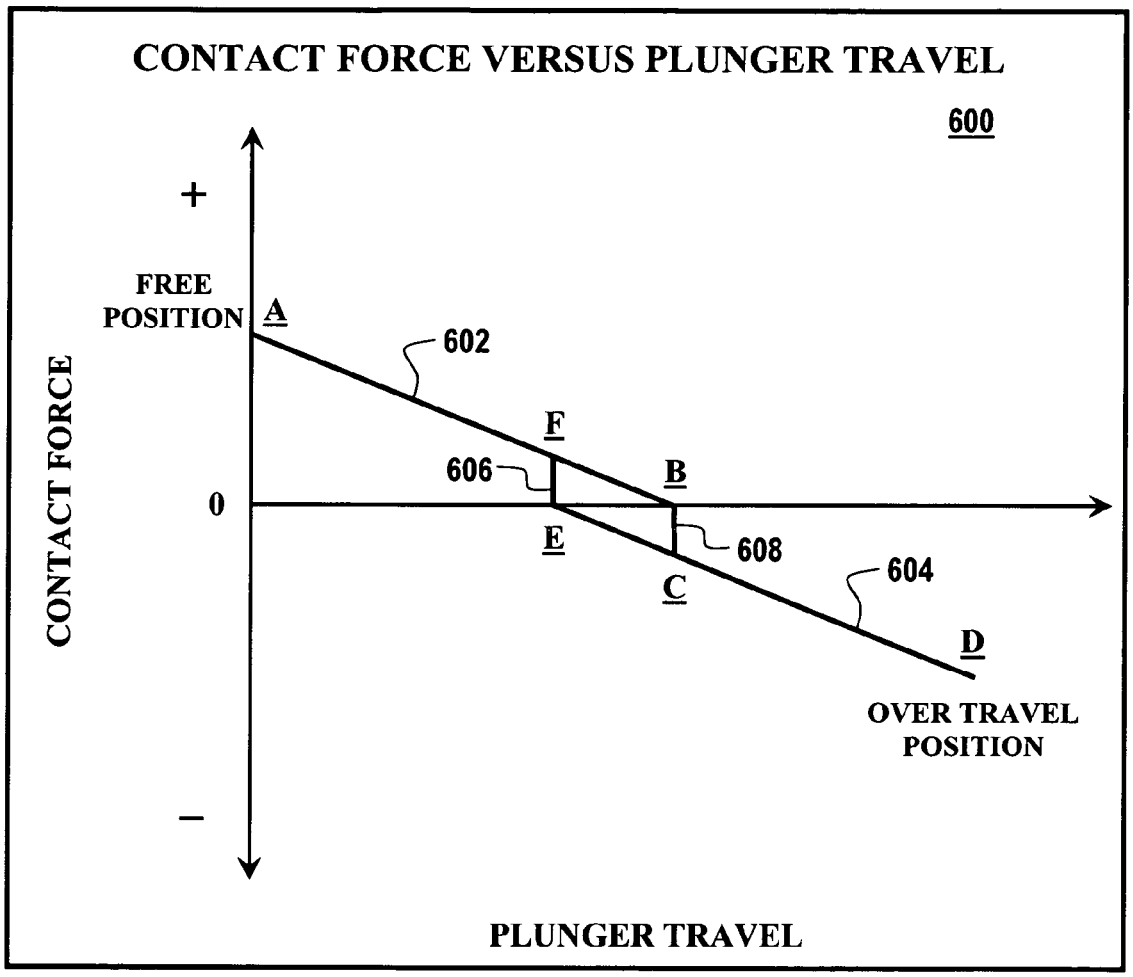
FIG. 6 illustrates a graph depicting contact force data versus plunger displacement data, in accordance with a preferred embodiment.

FIG. 6 illustrates a graph 600 depicting contact force data versus plunger displacement data, in accordance with a preferred embodiment. Graph 600 depicts a typical contact force versus plunger force travel curve representative of either a positive or negative rate switch. For a resilient-driven positive rate switch the contact force slowly decreases to zero at point B as the plunger moves toward the operate or snap-over position. Once the switch has operated, the moveable contact force becomes negative in value to indicate it is interfacing with the normally open stationary contact. In graph 600 line 602 indicates data between point A and B, while line 604 indicates data between point E and point D. Line 606 indicates data between point F and E, and line 608 indicates data between points B and C.

For the positive rate switch to release and transfer the moveable contact back to the normally closed stationary contact, the switch plunger is slowly allowed to move back to the release position, point E, and the moveable contact force again slowly decreases to zero. It is the slow creeping motion of the moveable contact through the zero contact force regions for a positive rate switch that leads to the erratic electrical non-contact, high contact resistance, arcing, welding, and so on.

For a rigid actuator driven negative rate switch, the operate force and position of the switch are located at point B, where contact force goes to zero, according to standard definitions for switch characteristics. However once a properly designed resilient actuator builds up enough force to overpower a negative rate switch plunger force at the stable free position point A, the switch plunger is driven quickly to the stable full over travel position with an accompanying decrease in plunger force. With a resilient actuator the meaningful switch operate force and position really coincides with the free position point A, and likewise the meaningful switch release force and position coincides with the full over travel position point D, rather than the standard defined release point E.

Stated another way, the operate position B and the release point E, where zero contact force may occur for a short amount of time with a resilient-driven positive rate switch, now move out to free position point A and over travel position point D with a resilient-driven negative rate switch. At the stable plunger travel locations, points A and D, an adequate amount of contact force is maintained before the sudden snap-over or snap-back of a negative rate switch. It is this higher level of contact force maintained prior to the operate or release stroke of the negative rate switch that helps to overcome the electrical contact performance issues described when using a positive rate switch.

Figure 7:
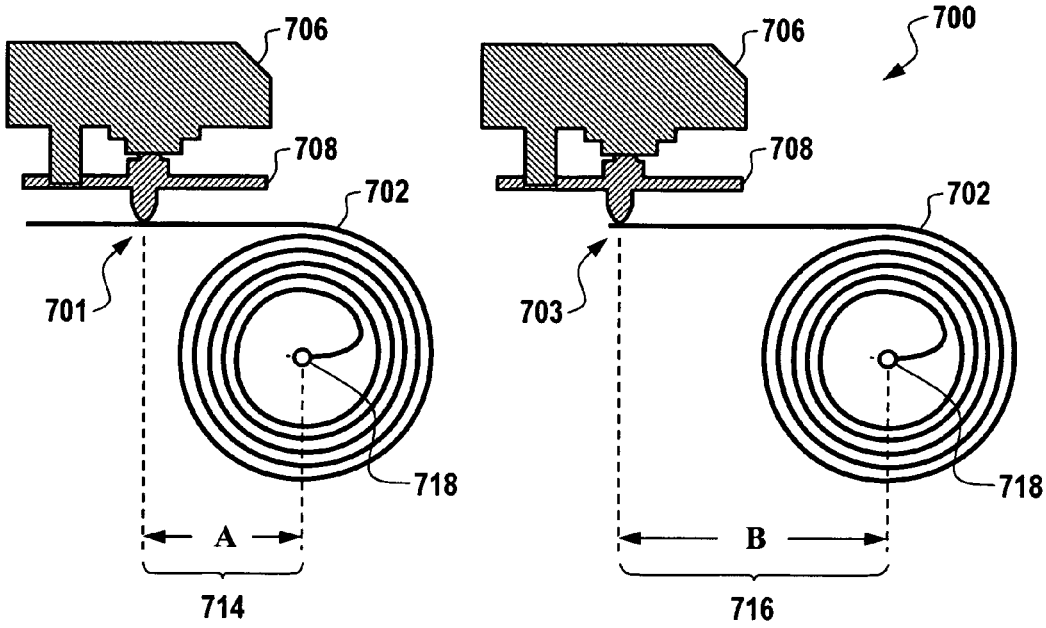
FIG. 7 illustrates a pictorial diagram depicting a negative rate switch in different locations on a bimetal coil, in accordance with preferred or alternative embodiments.

FIG. 7 illustrates a pictorial diagram depicting a negative rate switch 700 formed from switch portions 706, 708 in different locations 701, 703 on a bimetal coil 702 surrounding a central point 718, in accordance with preferred or alternative embodiments. Position 701 is located a distance 714 or A from central point 718, while position 703 is located a distance 716 or B from central point 718. The negative rate switch 700 provided as depicted in FIG. 7 thus includes switch portions 706, 708 in different locations on the bimetal coil 702 surrounding the central point 718. Note that switch portion 708 can function as a plunger or plunger component such as that shown in U.S. patent application Ser. No. 10/714,010, which is incorporated herein by reference. Recall that the present application is continuation-in-part of U.S. Pat. Ser. No. 10/714,010. The bimetal coil 702 can function as a resilient actuator. The negative rate switch 700 can therefore include a plunger 708 and a resilient actuator 702 thereof, wherein a highest plunger force occurs at a free position and a lowest plunger force occurs at a full over travel position. For an example of various other types of plungers, refer to U.S. patent application Ser. No. 10/714,010. As shown in FIG. 7, the negative rate switch 700 is configured such that when the resilient actuator 702 provides a resilient actuating force to overcome a free position force associated with the free position, the plunger 708 may move without interruption through a total range of travel thereof and when the resilient actuating force drops slightly below a full over-travel plunger force associated with the full over travel position, the negative rate switch 700 overcomes the resilient actuating force to return the plunger 708 to the free position thereof without interruption.

Figure 8:
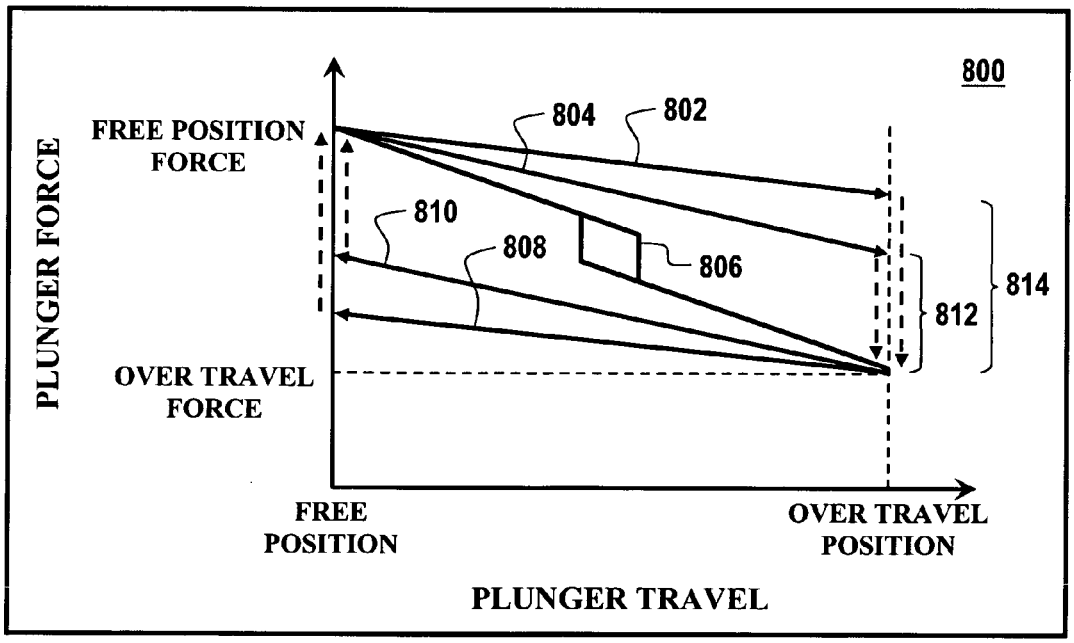
FIG. 8 illustrates a graph depicting control band change data for various actuation points on thermostatic bimetal, in accordance with preferred or alternative embodiments.

FIG. 8 illustrates a graph 800 depicting control band change data for various actuation points on thermostatic bimetal, in accordance with preferred or alternative embodiments. In graph 800, line 802 represents the bimetal spring rate at point B at T1. Line 804 represents the bimetal spring rate at point A at T1. Line 806 represents the ideal snap switch force-deflection curve, while line 810 represents the bimetal spring rate at point A at T2. Additionally, line 808 represents the bimetal spring rate at point B at T2. Additionally, reference numeral 812 is indicative of the control band at point A, while reference numeral 814 indicates the control band at point B.

In general, the control band of the Negative Rate Switch Approach for Resilient Actuating Devices can be adjusted by varying the position of the negative rate switch relative to the resilient actuator. For example, in a mechanical thermostat application, moving the point of contact on the bimetal coil can change the effective force-deflection spring rate of the bimetal coil with respect to the switch. By moving the point of actuation on the bimetal from position A to B (i.e., see FIG. 7), the effective spring rate of the bimetal decreases and the control band increases (i.e., refer to FIG. 8). This method of adjusting the control band can be accomplished without material or dimensional changes to either the switch or actuator.

Based on the foregoing, it can be appreciated that the embodiments disclosed herein generally relate to a negative rate switch comprising a plunger and a resilient actuator thereof, wherein a highest plunger force occurs at a free position and a lowest plunger force occurs at a full over travel position. The negative rate switch can be configured such that when the resilient actuator provides resilient actuating force to overcomes a free position force associated with the free position, the plunger moves without interruption through a total range of travel thereof and when the resilient actuating force drops slightly below a full over-travel plunger force associated with the full over travel position, the negative rate switch overcomes the resilient actuating force to return the plunger to the free position thereof without interruption.

The embodiments described herein can be utilized for a number of switching applications such as, for example, acceleration, buoyancy, air flow, temperature control, pressure control and the so forth. Acceleration actuation, for example, is an area that is encountered frequently in the electro-mechanical switching application. Sometimes appliance manufacturers utilize electro-mechanical switches to monitor "out of balance" conditions in their appliances, such as, for example, washing machines and clothes dryers. With the emphasis on reducing water and energy consumption, these appliances spin loads at much higher RPM's than they did a few years ago. In addition, it is now more common to find clothes washers and dryers on the 1 st and 2nd floors of homes—no longer relegated to the basement with its concrete floor. An out of balance condition can become quite noticeable with the higher RPM's and springier floors. Thus, the embodiments disclosed herein may find ideal use in such applications.

Based on the foregoing, it can be appreciated that a system can be implemented, which can include a negative rate switch, an external lever, and a mass in order to control an angle of rotation. Such a system potentially finds application in appliances where the lid possesses a safety interlock that deactivates/activates the appliance based on the angular position of the lid. The appliance must be energized when the lid opening is zero (closed) or below a specified distance and must be de-energized when the lid opening exceeds a certain distance. A good example of this type of application is a washing machine. A relatively small angular movement of the lid can be utilized to control functioning of the appliance.

For the most part, most appliance lids or door interlocks utilize some type of positional actuation. That is, the interlock switch can be physically actuated by a probe another other feature attached to the lid. Such a configuration typically requires a pointed probe attached to the moving lid of the appliance along with a hole pierced through the cover of the appliance. The hole and probe approach yields an appliance interlock system that typically is easily defeated and difficult to keep clean.

Enterprising kids, for example, who want to watch the washing machine tub spin may search for items to stick through the hole in the appliance cover in order to actuate the interlock switch. Though this is an obvious product misuse, it still leaves the appliance running in an unsafe condition. Because the hole and probe approach requires a hole through the cover of the appliance, the appearance of a clean appliance is upset.

The interlock hole is typically difficult to access and therefore difficult to keep clean. With a system comprised of a negative rate switch, an external lever and a mass, the entire device can be contained under the appliance cover. One example of an input that can cause the negative rate switch method type interlock to actuate or de-actuate is a change in the actuating moment. The actuating moment can be determined by the angular position of the negative rate switch, external lever, and mass system. The negative rate switch method type interlock is inherently tamper proof, and does not require any holes through the appliance cover and does not require any pointed or specially shaped probes attached to the appliance lid.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for actuating a negative rate switch, comprising the steps of:

providing a negative rate switch formed from switch portions in different locations on a bimetal coil surrounding a central point, said negative rate switch comprising a plunger and a resilient actuator thereof, wherein a highest plunger force occurs at a free position and a lowest plunger force occurs at a full over travel position; and utilizing said negative rate switch such that when said resilient actuator provides resilient actuating force to overcome a free position force associated with said free position, said plunger moves without interruption through a total range of travel thereof and when said resilient actuating force drops slightly below a full over-travel plunger force associated with said full over travel position, said negative rate switch overcomes said resilient actuating force to return said plunger to said free position thereof without interruption.

2. The method of claim 1 further comprising the step of properly matching said resilient actuator with said negative rate switch in order to permit said negative rate switch to function in a bi-stable manner that includes a plurality of points of stability.

3. The method of claim 2 wherein said resilient actuator is matched with said negative rate switch for pressure control activities.

4. The method of claim 2 wherein said resilient actuator is matched with said negative rate switch for temperature control activities.

5. The method of claim 2 wherein said resilient actuator is matched with said negative rate switch for acceleration control activities.

6. The method of claim 2 wherein said resilient actuator is matched with said negative rate switch for air flow control activities.

7. The method of claim 2 wherein said resilient actuator is matched with said negative rate switch for buoyancy control activities.

8. The method of claim 1 further comprising the step of adapting said negative rate switch for use with a thermostat.

9. The method of claim 8 wherein said thermostat comprises at least one thermostatic bimetal component.

10. The method of claim 1 further comprising the step of configuring said negative rate switch such that said resilient actuator pushes forward on said plunger for an operate stroke and said plunger pushes back on said resilient actuator upon activation of a release stroke or a return stroke.

11. A method for actuating a negative rate switch, comprising the steps of:

providing a negative rate switch formed from switch portions in different locations on a bimetal coil surrounding a central point, said negative rate switch comprising a plunger and a resilient actuator thereof, wherein a highest plunger force occurs at a free position and a lowest plunger force occurs at a full over travel position;

utilizing said negative rate switch such that when said resilient actuator provides resilient actuating force to overcome a free position force associated with said free position, said plunger moves without interruption through a total range of travel thereof and when said resilient actuating force drops slightly below a full over-travel plunger force associated with said full over travel position, said negative rate switch overcomes said resilient actuating force to return said plunger to said free position thereof without interruption;

properly matching said resilient actuator with said negative rate switch in order to permit said negative rate switch to function in a bi-stable manner that includes a plurality of points of stability; and utilizing said negative rate switch such that said resilient actuator pushes forward on said plunger for an operate stroke and said plunger pushes back on said resilient actuator upon activation of a release stroke or a return stroke.

12. The method of claim 11 further comprising the step of adapting said negative rate switch for use with a thermostat, wherein said thermostat comprises at least one thermostatic bimetal component.

13. A system for actuating a negative rate switch, comprising:

a negative rate switch including switch portions in different locations on a bimetal coil surrounding a central point, said negative rate switch comprising a plunger and a resilient actuator thereof, wherein a highest plunger force occurs at a free position and a lowest plunger force occurs at a full over travel position; and wherein when said resilient actuator provides a resilient actuating force to overcome a free position force associated with said free position, said plunger moves without interruption through a total range of travel thereof and when said resilient actuating force drops slightly below a full over-travel plunger force associated with said full over travel position, said negative rate switch overcomes said resilient actuating force to return said plunger to said free position thereof without interruption.

14. The system of claim 13 wherein said resilient actuator is properly matched with said negative rate switch in order to permit said negative rate switch to function in a bi-stable manner that includes a plurality of points of stability.

15. The system of claim 14 wherein said resilient actuator is matched with said negative rate switch for pressure control activities.

16. The system of claim 14 wherein said resilient actuator is matched with said negative rate switch for temperature control activities.

17. The system of claim 14 wherein said resilient actuator is matched with said negative rate switch for acceleration control activities.

18. The system of claim 14 wherein said resilient actuator is matched with said negative rate switch for air flow control activities.

19. The system of claim 14 wherein said resilient actuator is matched with said negative rate switch for buoyancy control activities.

20. The system of claim 13 wherein said negative rate switch is adapted for use with a thermostat.

21. The system of claim 17 wherein said thermostat comprises at least one thermostatic bimetal component.

22. The system of claim 13 wherein said resilient actuator pushes forward on said plunger for an operate stroke and said plunger pushes back on said resilient actuator upon activation of a release stroke or a return stroke.

23. The system of claim 13 wherein a control band associated with said negative rate switch is adjustable by varying a position of said negative rate switch relative to said resilient actuator or by varying a position of said resilient actuator relative to said negative rate switch.

* * * * *